US007086891B2

(12) United States Patent
Liao

(10) Patent No.: US 7,086,891 B2
(45) Date of Patent: Aug. 8, 2006

(54) ELECTRICAL PLUG WITH PROTECTION STRUCTURE

(76) Inventor: Sheng-Hsin Liao, No. 10, Alley 38, Lane 229, San Chun St., Shu Lin City, Taipei Hsien (TW)

( * ) Notice: Subject to any disclaimer, the term of this patent is extended or adjusted under 35 U.S.C. 154(b) by 0 days.

(21) Appl. No.: 11/038,126

(22) Filed: Jan. 21, 2005

(65) Prior Publication Data

US 2005/0124207 A1 Jun. 9, 2005

Related U.S. Application Data

(63) Continuation-in-part of application No. 10/419,210, filed on Apr. 21, 2003, now abandoned.

(51) Int. Cl.
*H01R 11/20* (2006.01)

(52) U.S. Cl. ..... 439/418

(58) Field of Classification Search ..... 439/418, 439/344, 354; 174/66–67

See application file for complete search history.

(56) References Cited

U.S. PATENT DOCUMENTS 583,005 A * 5/1897 Watanabe ..... 30/233.5
4,241,974 A * 12/1980 Hardesty ..... 439/638
4,406,509 A * 9/1983 Jagen ..... 439/354
4,501,464 A * 2/1985 Bogese, II ..... 439/344
5,505,638 A * 4/1996 Su et al. ..... 439/676
5,562,475 A * 10/1996 Kern et al. ..... 439/344
5,579,425 A * 11/1996 Lampert et al. ..... 385/59
5,685,731 A * 11/1997 Lin ..... 439/344
5,685,736 A * 11/1997 Lung ..... 439/447
5,830,005 A * 11/1998 Watanabe ..... 439/418
5,899,770 A * 5/1999 Ezawa ..... 439/418
5,951,330 A * 9/1999 Reichard et al. ..... 439/676
6,196,733 B1 * 3/2001 Wild ..... 385/86
6,250,949 B1 * 6/2001 Lin ..... 439/418
6,322,386 B1 * 11/2001 Tharp et al. ..... 439/344
6,398,576 B1 * 6/2002 Hwang et al. ..... 439/354
D466,479 S * 12/2002 Pein et al. ..... D13/147
6,506,070 B1 * 1/2003 Huang ..... 439/352
2005/0054230 A1 * 3/2005 Huang ..... 439/344

* cited by examiner

*Primary Examiner*—Gary F. Paumen
*Assistant Examiner*—Larisa Tsukerman
(74) *Attorney, Agent, or Firm*—Rosenberg, Klein & Lee

(57) ABSTRACT

An electrical plug of the invention has a plug body, a plurality of terminals, a connector, a plurality of conductive wires and a protection cover (structure). A plurality of terminal slots is formed in a front side of the plug body for respectively receiving a plurality of terminals. A sleeve is formed on a rear side of the connector, and a plurality of wire slots is formed in a front side of the connector. The conductive wires penetrate through the sleeve of the connector and are respectively fastened inside the wire slots. The conductive wires are electrically connected to the terminals after the terminals respectively pierce the conductive wires. The protection cover (structure) is mounted on the connector to cover the resilient element of the plug body.

17 Claims, 14 Drawing Sheets

ELECTRICAL PLUG WITH PROTECTION STRUCTURE

CROSS-REFERENCE TO RELATED APPLICATIONS

This Application is a Continuation-in-Part of application Ser. No. 10/419,210, filed 21 Apr. 2003, now abandooned and entitled ELECTRICAL PLUG WITH PROTECTION COVER.

BACKGROUND OF THE INVENTION

1. Field of the Invention

The invention relates to an electrical plug having a protection cover (structure) and, more particularly, an electrical plug having a protection cover (structure) that can electrically connect a plurality of conductive wires and be manufactured with a reduced production cost.

2. Description of the Related Art

Referring to FIG. 1, a conventional electrical plug used to electrically connect a plurality of conductive wire is suitable for connecting computer or telephone lines. The electrical plug includes a plug body 10*a* on a top of which a resilient element 11*a* is, mounted for positioning. A plurality of terminals 12*a* is movably mounted in a bottom of the plug body 10*a* in a manner to move in a lengthwise direction within a short distance. Between the tops of each terminal 12*a* and the body 10*a* is mounted a connector 13*a* having a plurality of square slots 14*a* for external communication. The opened sides of square slots 14*a* respectively correspond to the terminals 12*a*, so that the terminals 12*a* insert into the connector 13*a* through the square slots 14*a*. The connector 13*a* further has a plurality of grooves (not shown).

When a plurality of conductive wires 20*a* are to be connected to the plug, the conductive wires 20*a* are inserted into the grooves of the connector 13*a* from a rear side of the body 10*a*. The terminals 12 are inserted into the connector 13*a* through the square slots 14*a* to pierce the conductive wires 20*a*, and thereby electrically connect with the conductive wires 20*a*.

In the above plug, the resilient element 11*a* protrudes from the body 10*a* and thus is likely to be damaged by, for example, bumping or bending, which may reduce the service life of the plug.

SUMMARY OF THE INVENTION

It is therefore an object of the invention to provide an electrical plug with a protection cover (structure) mounted on a connector thereof. The protection cover (structure) covers a resilient element of the plug body to protect the resilient element from impact or damaging vibrations, which thereby improves the service life of the electrical plug.

To accomplish the above and other objectives, an electrical plug of the invention includes a plug body, a plurality of terminals, a connector, a plurality of conductive wires and a protection cover (structure). The plug body has an internal accommodating space and an external surface on which is mounted a resilient element. A plurality of terminal slots is formed in a front side of the plug body to communicate with the accommodating space. Each of the terminals is inserted into a corresponding terminal slot. The connector is located inside the accommodating space of the plug body. A sleeve is formed on a rear side of the connector, and a plurality of wire slots are formed in a front side of the connector. The conductive wires penetrate through the sleeve of the connector and are respectively fastened inside the wire slots. The conductive wires are electrically connected to the terminals after the terminals respectively pierce the conductive wires. The protection cover (structure) is mounted on the connector to cover the resilient element of the plug body.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
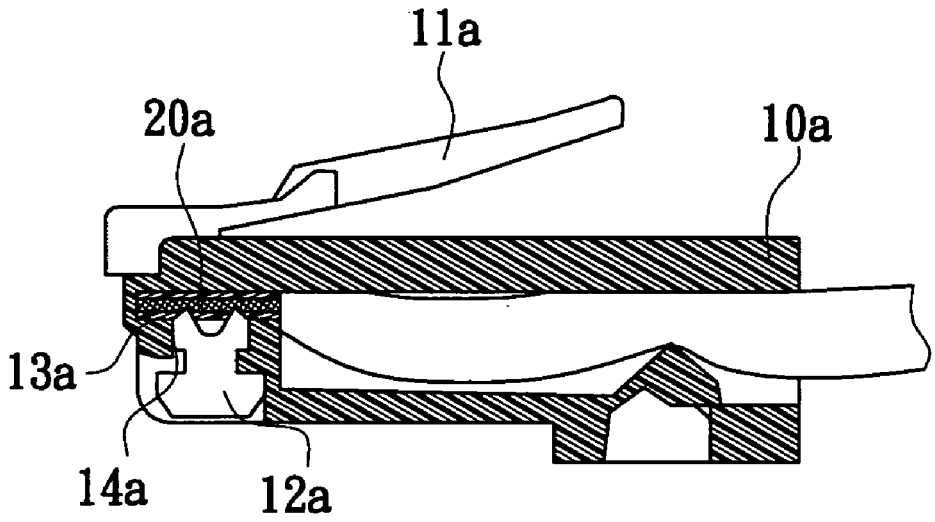
FIG. 1 PRIOR ART
FIG. 1 is a cross-sectional view of a conventional electrical plug.

Wherever possible in the following description, like reference numerals will refer to like elements and parts unless otherwise illustrated.

Referring to FIGS. 2–5, an electrical plug according to a first embodiment of the invention includes a plug body 10, a plurality of terminals 20, a connector 30 and a plurality of conductive wires 40.

The plug body 10 is made of an insulating material such as plastic. A resilient element 11 is mounted on an external surface of the plug body 10. An accommodating space 12 with an opened rear side is formed inside the plug body 10. A plurality of terminal slots 13 is formed in a front side of the plug body 10 to communicate with the accommodating space 12. The terminal slots 13 are regularly spaced by a constant separating distance.

The terminals 20 are made of a conductive material such as copper. Each of the terminals 20 is inserted into a corresponding terminal slot 13. Furthermore, each terminal 20 has a sharp tip 21 to connect electrically to a corresponding conductive wire 40.

Figure 2:
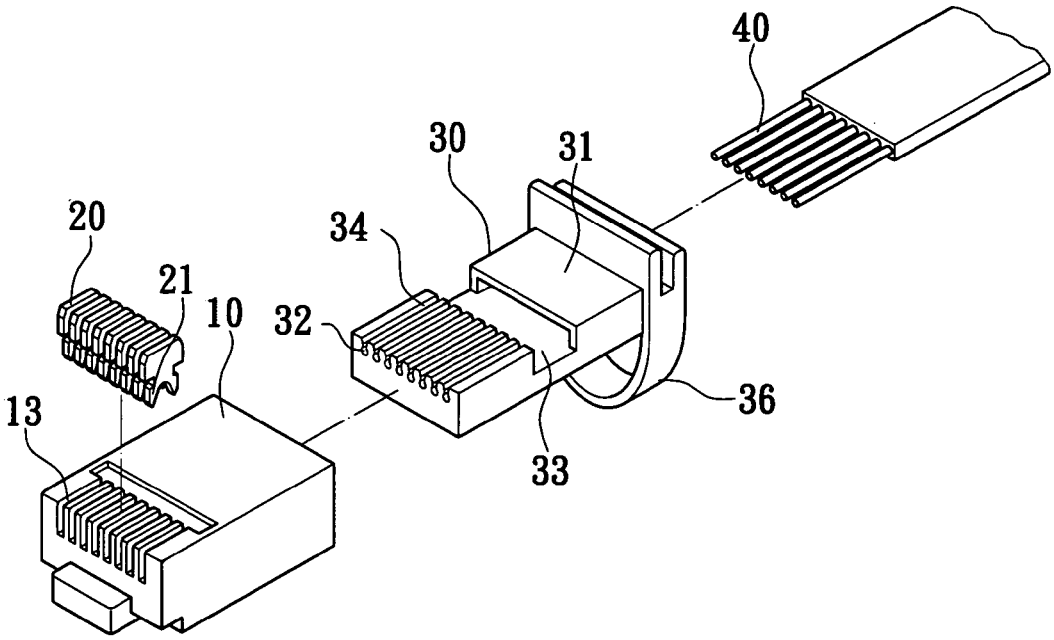
FIG. 2 is an exploded view of an electrical plug having a protection cover (structure) according to a first embodiment of the invention.
Figure 2A:
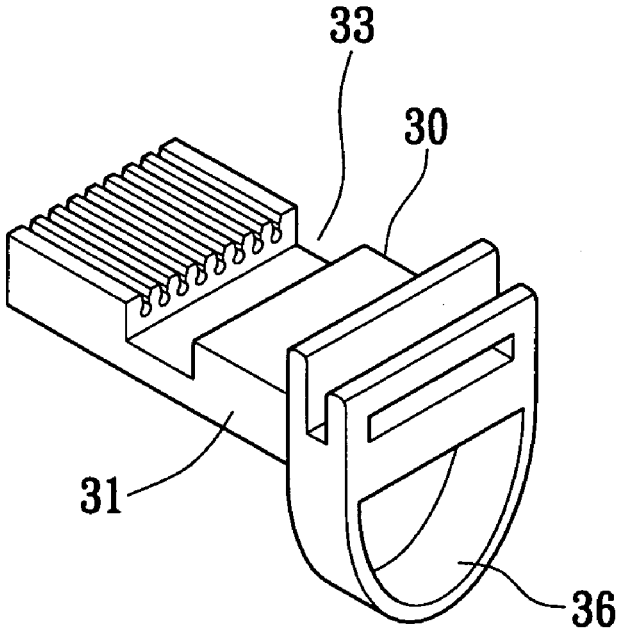
FIG. 2A is a perspective view of a connector of an electrical plug according to a first embodiment of the invention.
Figure 3:
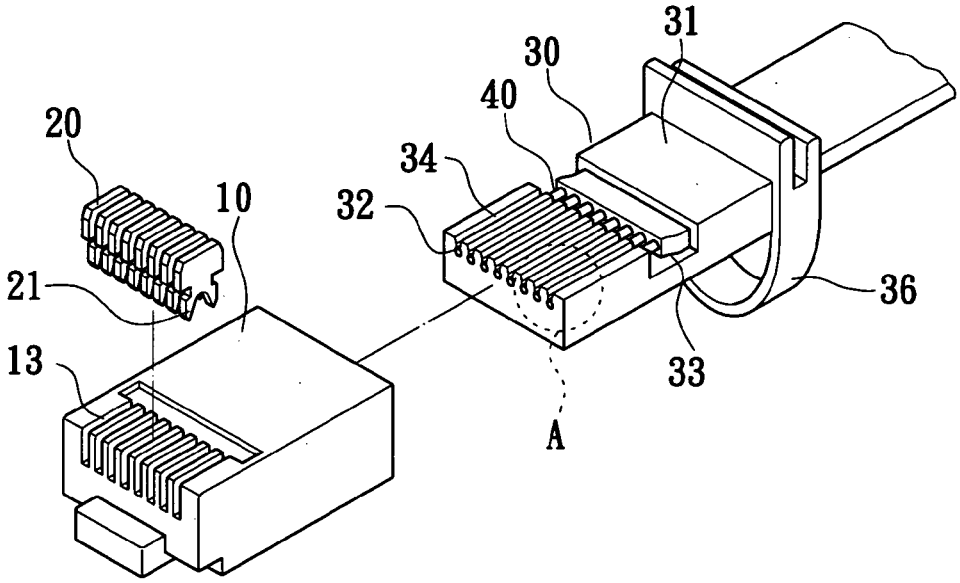
FIG. 3 is an exploded view of an electrical plug in which conductive wires are connected to the connector according to a first embodiment of the invention.
Figure 3A:
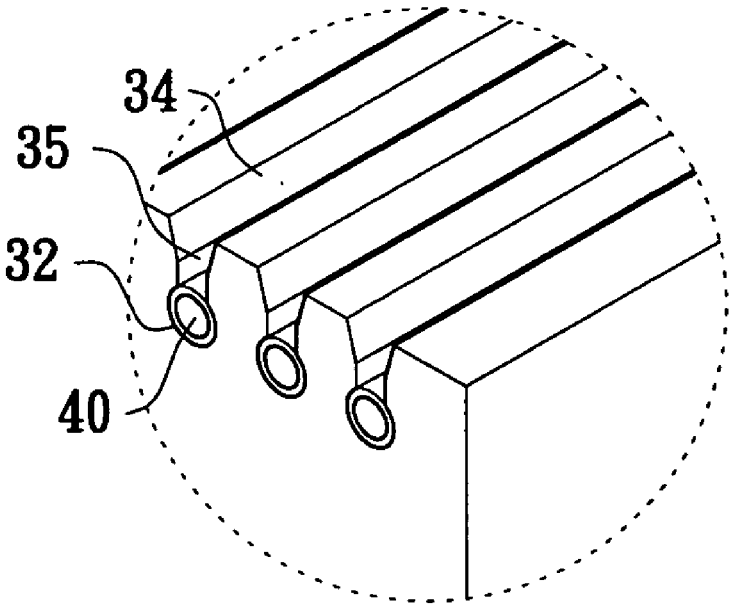
FIG. 3A is an enlarged view of part A of FIG. 3.
Figure 4:
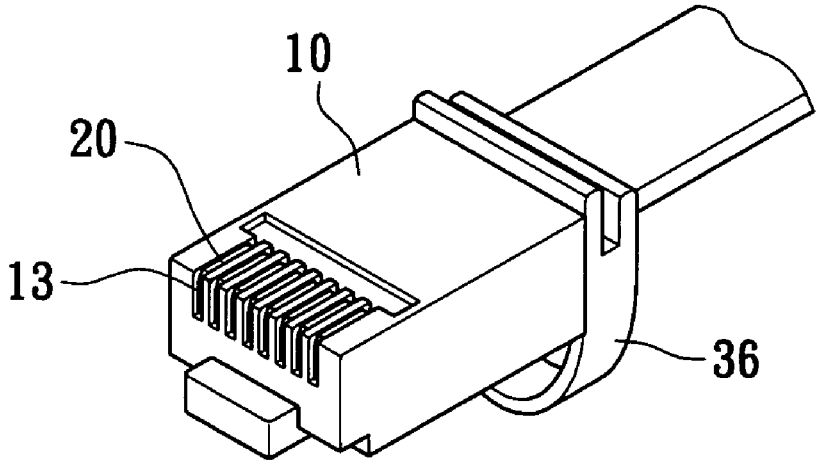
FIG. 4 is a perspective of an electrical plug according to a first embodiment of the invention.

The connector 30 is made of an insulating material such as plastic. A sleeve 31 is formed on a rear side of the connector 30, as shown in FIG. 2A and FIG. 3A. The sleeve 31 has two open ends for receiving the conductive wires 40. A plurality of wire slots 32 is formed in a front side of the connector 30, with a recess 33 between the wire slots 32 and the sleeve 31. The wire slots 32 are equally spaced on the connector 30. An opening having a guiding incline surface 34 and a narrow bottom 35 is formed in the connector 30 to communicate with each wire slot 32. The wide mouth 34 further has a slanted sidewall. The narrow bottom 35 is narrower than an inner width of the wire slot 32. A protection cover (structure) 36 is further mounted on an external surface of the connector 35. The protection cover (structure) 36 is integrally formed with the connector 30. The protection cover (structure) 36 is a hollow casing through which is inserted the resilient element 11 of the body 10.

Figure 5:
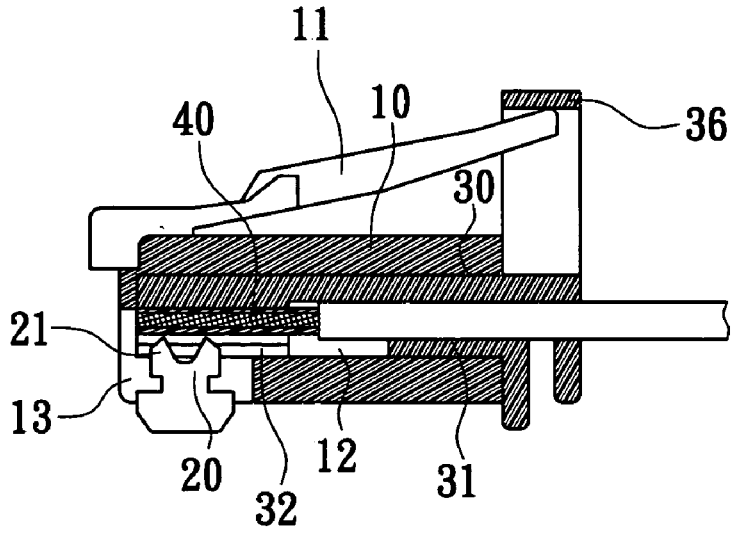
FIG. 5 is a cross-sectional view of an electrical plug connected to terminals according to a first embodiment of the invention.
Figure 6:
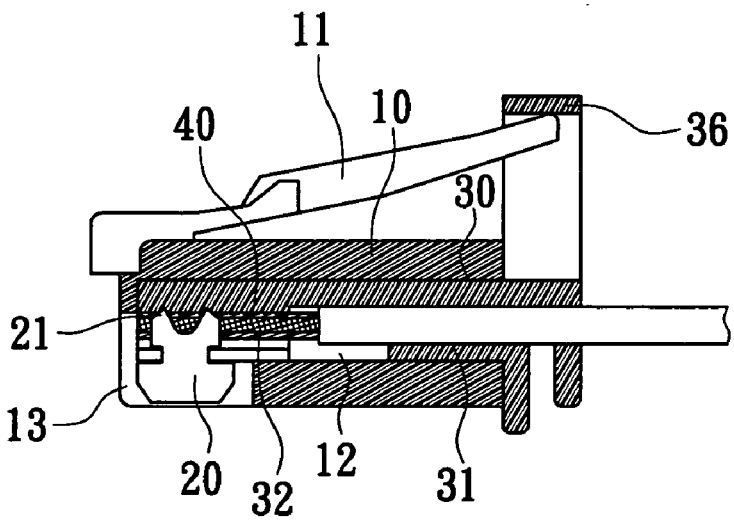
FIG. 6 is a cross-sectional view of an electrical plug in which a terminal is pressed down inside a corresponding terminal slot according to a first embodiment of the invention.

After the conductive wires 40 penetrate the sleeve 31 and the recess 33 from a rear side of the sleeve 31 of the connector 30, the conductive wires 40 are respectively distributed in the narrow bottoms 35. Then, the conductive wires 40 are fixedly fastened inside the corresponding wire slots 32 by applying an external force to press the conductive wires 40 into the wire slots 32. The conductive wires thereby are securely connected to the connector 30, as shown in FIG. 3. The connector 30 is inserted into the accommodating space 12 of the body 10 from a rear side of the accommodating space 12. Through snap fitting of the connector 30 in the accommodating space 12, the portions of the conductive wires 40 protruding from the connector 30 further insert inside the body 10 near its front side, as shown in FIG. 5. When the connector 30 is assembled with the body 10, the protection cover (structure) 3 covers the resilient element 11 of the body 10. Thereafter, the terminals 20 are pressed down inside the terminal slots 13 until the sharp tip 21 of each terminal 20 pierces the corresponding conductive wire 40 to achieve an electrical connection of the terminal 20 with the conductive wire 40, as shown in FIG. 6. An electrical plug with a protection cover (structure) is thereby constructed.

As described above, the conductive wires 40 are connected to the connector 30 before being electrically connected to the terminals 20 of the body 10. The guiding incline surface 34 of the wire slot 32 enables the conductive wire 40 to fasten easily inside the wire slot 32 through the narrow bottom 35, narrow bottom 35 being narrower than the inner width of the wire slot 32 and an outer diameter of the conductive wire 40, respectively. The conductive wires 40 fastened inside the wire slots 32 thereby are prevented from slipping away from the wire slots 32.

The protection cover (structure) 3 mounted on the external surface of the connector 30 covers the resilient element 11 of the body 10 when the connector 30 is assembled with the body 10. The resilient element 11 is thereby protected against external impact or vibrations, which advantageously prolongs the service life of the electrical plug.

Figure 7:
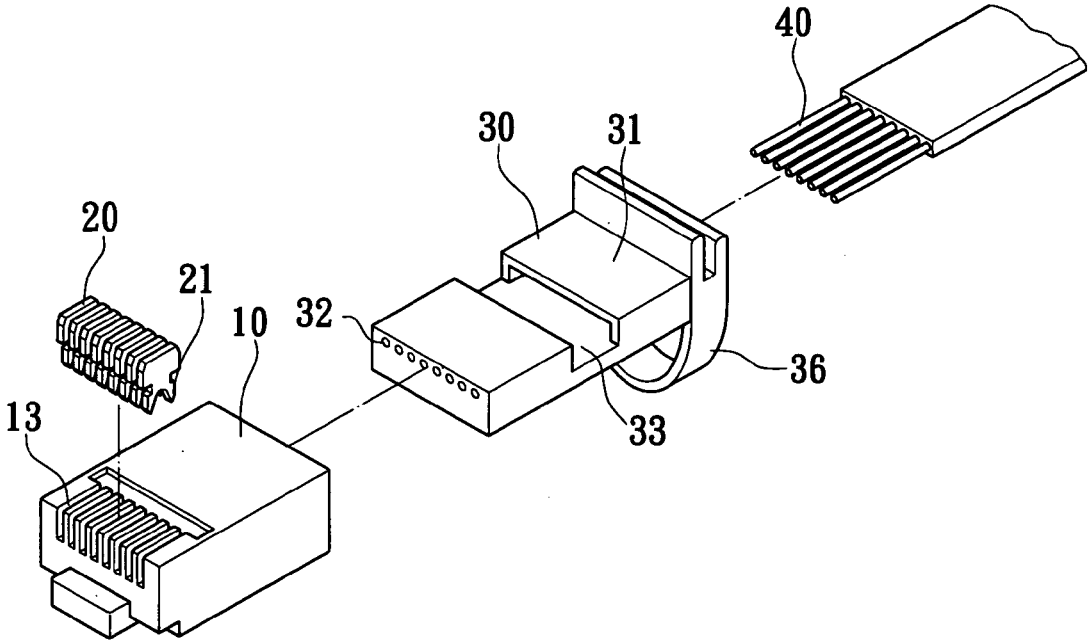
FIG. 7 is an exploded view of an electrical plug according to a second embodiment of the invention.
Figure 8:
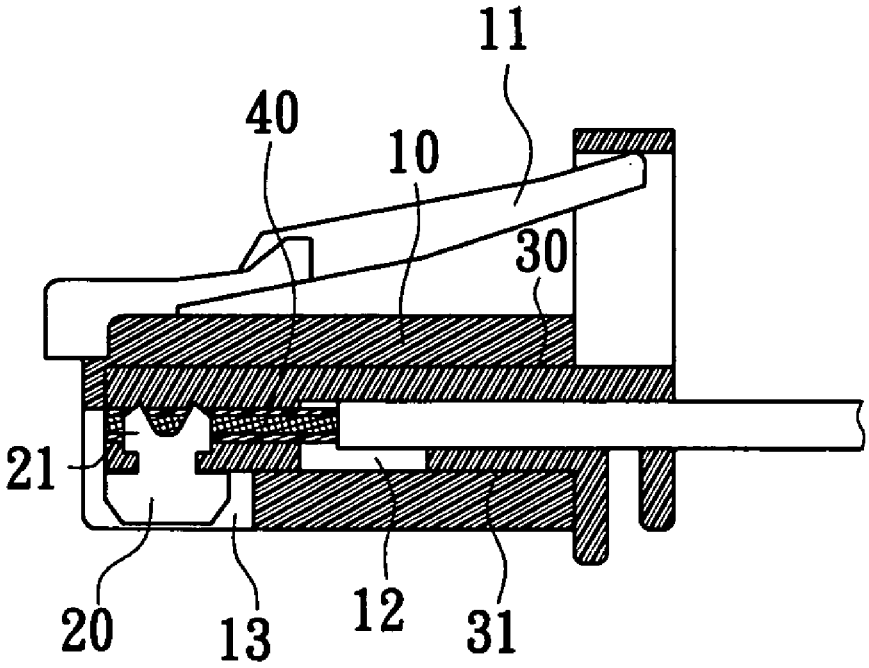
FIG. 8 is a cross-sectional view of an electrical plug according to a second embodiment of the invention.

Referring to FIG. 7 and FIG. 8, the wire slots 32 in the front side of the connector 30 can have a cylindrical shape with two open ends. In this case, the conductive wires 40 are respectively inserted the corresponding wire slots 32 from their rear sides to connect electrically to the connector 30. With snap fitting of the connector 30 to the accommodating space 12 of the body 10, the conductive wires 40 connected to the connector 30 are firmly placed inside the body 10. Then, the terminals 20 are respectively pressed down in the corresponding terminal slots 13 until they pierce the conductive wires 40, which thereby electrically connect the terminals 20 to the conductive wires 40.

Figure 9:
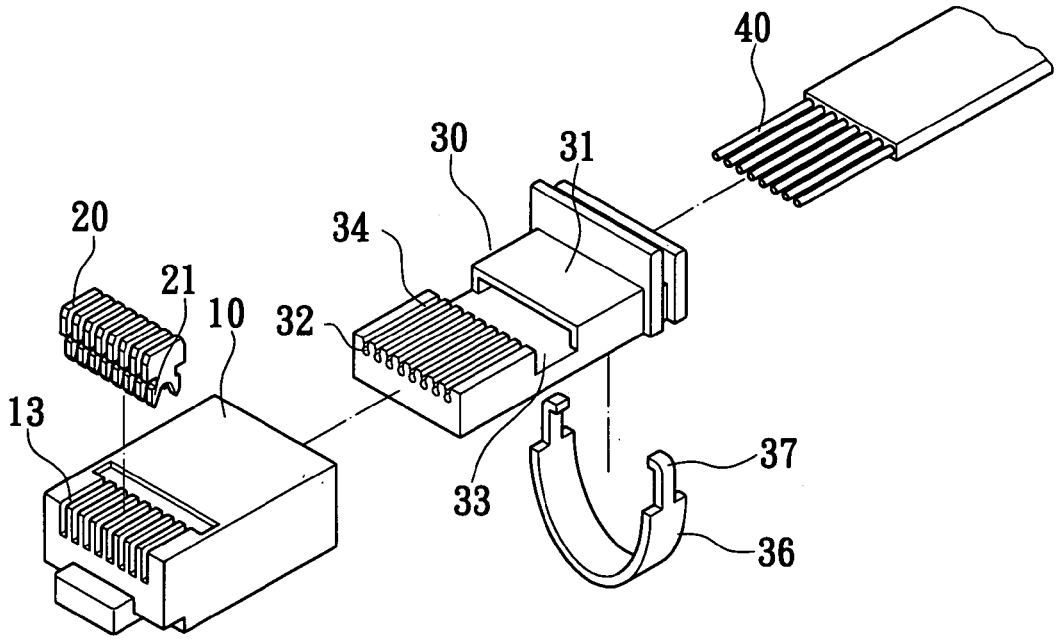
FIG. 9 is an exploded view of an electrical plug according to a third embodiment of the invention.
Figure 10:
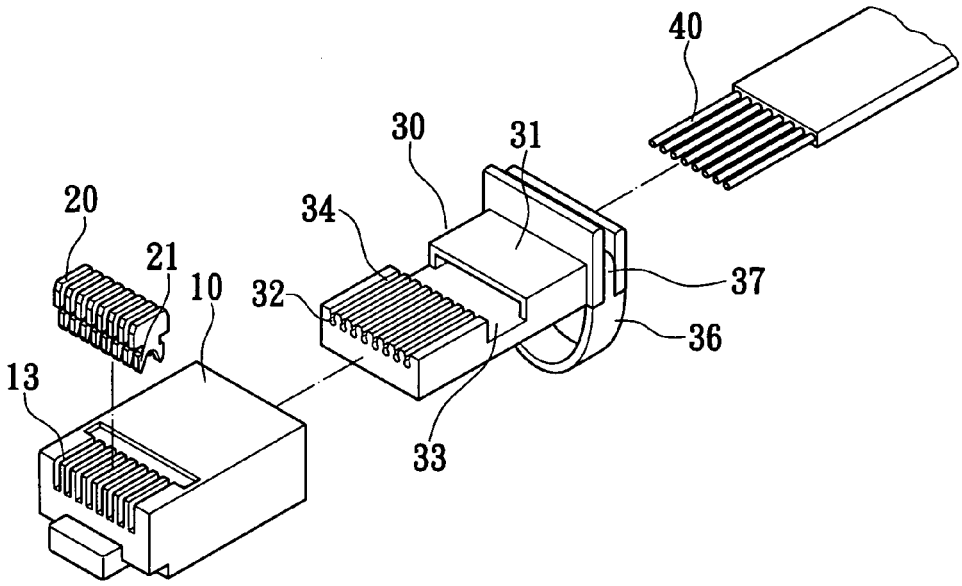
FIG. 10 is a perspective view of an electrical plug according to a third embodiment of the invention.

Referring to FIG. 9 and FIG. 10, the protection cover (structure) 3 can be detachably mounted on the connector 30. In this case, snapping parts 37 are further provided at opposite ends of the protection cover (structure) 36 to snap fit with the connector 30. When the connector 30 is assembled with the body 10, the protection cover (structure) 3 covers and protects the resilient element 11 of the body 10.

Figure 11:
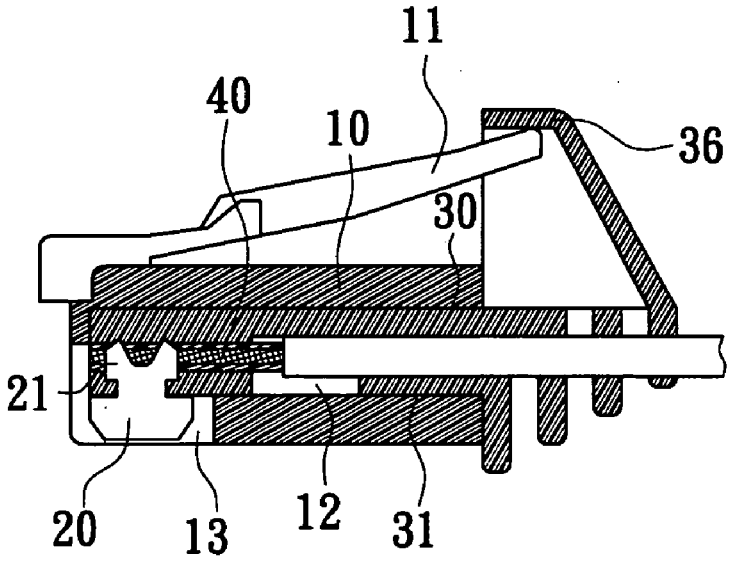
FIG. 11 is a cross-sectional view of an electrical plug according to a fourth embodiment of the invention.

Referring to FIG. 11, the protection cover (structure) 3 can be a hollow casing with an open front end and a closed rear end.

Figure 12:
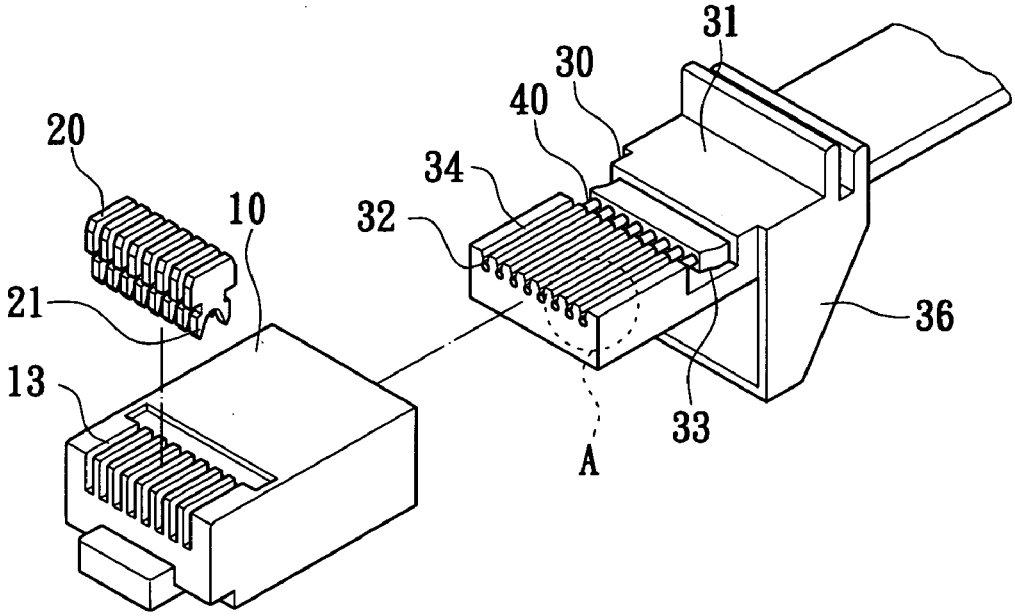
FIG. 12 is an exploded view of an electrical plug according to a fifth embodiment of the invention.
Figure 13:
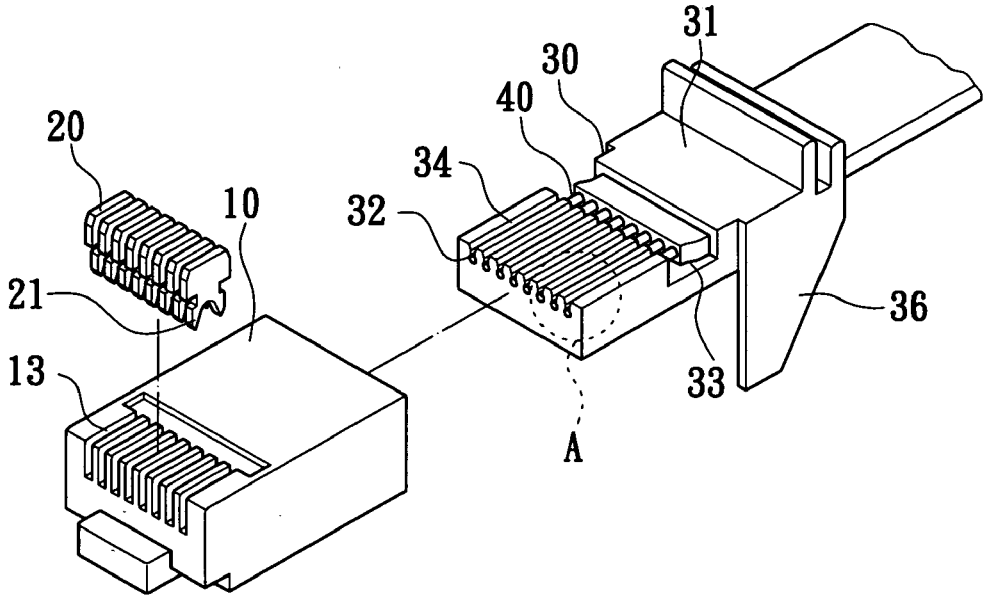
FIG. 13 is an exploded view of an electrical plug according to a sixth embodiment of the invention.

Specially new application embodiment from the figure of FIG. 12 and FIG. 13, the protection structure is by the shape of half ring or the shape with two parallel wall to protect the resilient element in the transverse direction (the parallel wall can have cover or without cover.) The inventor add the protection structure by the feature of two parallel wall having the function of to essentially protection to resilient element and cost saving of plastic injection tooling Wherein a recess is formed between the wire slot and the sleeve, the sleeve hole facing to the wire slot, the sleeve and the wire slot connected on one body. The special function of the above description is that the recess 33 has the modulation ability to modulate the wire penetrating the sleeve 31 to insert into the wire slot 32 at the moment of wire assembling to the connector 30. In addition the sleeve 31 and the wire slot 32 connected on one body have the function of simplifying the structure of connector 30 for ease of assembly.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An electrical plug having a protection structure, comprising:

a plug body having an internal accommodating space and an external surface having a resilient latch thereon, wherein a plurality of terminal slots is formed in a front side of the plug body to communicate with the accommodating space;

a plurality of terminals, each of the terminals being inserted into a corresponding terminal slots;

a connector extending into the accommodating space of the plug body, wherein a sleeve defining a longitudinal passage is formed on a rear portion of the connector and a plurality of wire slots are formed in a front portion of the connector, the connector including at least a first protrusive plate member disposed to extend longitudinally from the sleeve, the first protrusive plate member projecting transversely beyond the sleeve for stopping engagement of the plug body and defining an opening communicating with the longitudinal passage of the sleeve;

a plurality of conductive wires, passing through the opening and longitudinal passage defined respectively by the protrusive plate member and sleeve of the connector and respectively fastened inside the wire slots, wherein the conductive wires are electrically connected to the terminals after the terminals respectively pierce the conductive wires; and a protection structure extending transversely outward from opposed peripheral side portions of the connector to at least partially surround a free end of the resilient latch of the plug body.

2. The electrical plug of claim 1, wherein the accommodating space of the plug body has an open rear end.

3. The electrical plug of claim 1, wherein each terminal has a sharp tip to pierce a corresponding conductive wire to achieve electrical connection.

4. The electrical plug of claim 1, wherein the wire slots have an opening formed at a side wall thereof, and a conductive wire is placed from the opening of each of the wire slots.

5. The electrical plug of claim 4, wherein the wide mouth of the wire slot has a slanted sidewall.

6. The electrical plug of claim 4, wherein the wire slot has a bottom narrower than the wire slot.

7. The electrical plug of claim 1, wherein the sleeve of the connector has two open ends.

8. The electrical plug of claim 1, wherein the sleeve of the connector has an opened front end and a closed end.

9. The electrical plug of claim 1, wherein a recess is formed between the wire slot and the sleeve, the sleeve hole facing to the wire slot, the sleeve and the wire slot connected on one body.

10. The electrical plug of claim 1, wherein the protection structure is integrally formed with the connector.

11. The electrical plug of claim 1, wherein the protection structure snap fits with the connector.

12. The electrical plug of claim 1, further comprising a second protrusive plate member disposed in longitudinally spaced manner from the first protrusive plate member, the second protrusive plate member defining a second opening aligned with the opening defined by the first protrusive plate member.

13. The electrical plug of claim 12, wherein the first and second protrusive plate members are stepped in protrusive height relative to the sleeve.

14. The electrical plug of claim 1, wherein the protection structure includes a substantially semi-circular shape member arching radially outward from the connector to protectively extend in collaring manner about the free end of the resilient element.

15. The electrical plug of claim 14, wherein the substantially semi-circular shape member is detachably coupled to the connector.

16. The electrical plug of claim 1, wherein the protection structure includes a hollow casing member extending transversely outward from the connector to define a protective hood about the free end of the resilient latch.

17. The electrical plug of claim 1, wherein the protection structure includes a pair of laterally spaced walls extending transversely outward from the connector to laterally shield the free end of the resilient latch.

* * * * *